US005772468A

United States Patent [19]

Kowalski et al.

[11] Patent Number: 5,772,468

[45] Date of Patent: Jun. 30, 1998

[54] CLAMP ASSEMBLY FOR A BATTERY BOOSTER CABLE

[75] Inventors: Wayne J. Kowalski, Buffalo Grove; Robert J. Holpuch, Arlington Heights, both of Ill.

[73] Assignee: Coleman Cable System, Inc., Savannah, Ga.

[21] Appl. No.: 723,218

[22] Filed: Sep. 27, 1996

[51] Int. Cl.[6] ..... H01R 11/00

[52] U.S. Cl. ..... 439/506; 439/822

[58] Field of Search ..... 439/506, 759, 439/822, 819, 755

[56] References Cited

U.S. PATENT DOCUMENTS

| | | | |
|---|---|---|---|
| 4,449,772 | 5/1984 | Johnson, III | 339/29 B |
| 4,453,791 | 6/1984 | Ledbetter | 339/29 B |
| 4,685,760 | 8/1987 | Mize | 439/822 |
| 4,826,457 | 5/1989 | Varatta | 439/755 |
| 4,923,415 | 5/1990 | Lee | 439/755 |
| 4,929,199 | 5/1990 | McKinnon | 439/759 |
| 4,934,957 | 6/1990 | Bellusci | 439/504 |
| 5,002,508 | 3/1991 | Craveiro | 439/755 |
| 5,021,008 | 6/1991 | Scherer | 439/504 |

*Primary Examiner*—Khiem Nguyen
*Assistant Examiner*—Eugene Byrd
*Attorney, Agent, or Firm*—Rudnick & Wolfe

[57] ABSTRACT

A clamp assembly for a battery booster cable for removable attachment to a battery terminal. The clamp assembly includes a pair of clamp members each having a jaw portion and a handle portion. One of the jaw portions is configured with an electrically conductive edge portion, and the other jaw portion is configured with a non-conductive edge portion. The electrically conductive edge portion and non-conductive edge cooperate to securely mount the clamp assembly to the battery terminal. A pivot member joins the clamp members together between the respective jaw and handle portions thereof to allow pivotal movement of the clamp members relative to one another about the pivot member. A biasing member is also disposed on the clamp members for normally urging the handle portions apart and the jaw portions together about the pivot member.

27 Claims, 5 Drawing Sheets

CLAMP ASSEMBLY FOR A BATTERY BOOSTER CABLE

FIELD OF THE INVENTION

The present invention relates generally to a battery booster cable, and more particularly, to a clamp assembly that is used in connection therewith for removable securement to a battery terminal.

BACKGROUND OF THE INVENTION

Battery "booster" or "jumper" cables are well known in the art for electrically interconnecting a discharged battery of a stalled vehicle in parallel with an external source of electrical energy, typically the charged battery of another vehicle. This is done to draw sufficient current from the charged battery to temporarily increase the capacity of the discharged battery, thereby allowing the stalled vehicle to be started. Typically, a pair of electrically conductive cables are joined together in side-by-side relationship to form a single booster cable which is easy to transport. Each cable has a pair of hand operated clamps at opposite ends thereof for securely interconnecting the cables to the corresponding terminals on the charged and discharged batteries. One pair of opposing clamps are denoted as being connected to a negatively charged cable, and the other pair of opposing clamps are denoted as being connected to a positively charged cable. Typically, the clamps are labeled in some manner to indicate attachment to the positive or negative cable, such as by providing insulated red handles for the positive clamps and insulated black handles for the negative clamps. To charge a battery, the opposing positive clamps of the positive cable are secured to the corresponding positive terminals of the charged and discharged batteries. One of the negative clamps on the negative cable is connected to the negative terminal of the charged battery, and the opposite negative clamp is connected to a ground connection of the stalled vehicle.

The clamps are typically configured with a pivot pin joining cooperating jaw portions at one end and handle portions at the other. A spring operably engages the handle portions to force the handle portions apart and urge the jaw portions toward a closed position. The jaw portions can be forceably separated by gripping the handle portions and pivoting them toward each other. Release of the handles enables the jaws to close on the terminal of a battery. To facilitate securement of the jaws to the terminal, each jaw is typically provided with a serrated edge. In some prior art devices, the entire clamp is made of a conductive material, and the end of the cables are connected directly to one of the handles of each clamp. Since the current flows through the entire handle portion of the clamps, the electrical resistance of the handle creates a voltage drop, which limits the current carrying capacity of the clamp. The current flow through the handle also creates a heat rise at the gripping surface of the handles.

Other prior art clamps attempt to avoid these problems by electrically bonding each cable to a separate electrically conductive contact jaw, which is mechanically attached to one of the jaw portions of each clamp. Thus, the flow of the boost current is primarily through the electrically conductive contact jaw and is substantially isolated from the handle portion of the clamp. This maximizes current flow to the battery terminal and minimizes the heat buildup of the handles.

Notwithstanding the foregoing advancements in the field of battery booster cables, the process of connecting the clamps to the terminals of the batteries can be hazardous, especially when one of the batteries is in a discharged condition. The rush of current from the charged battery to the discharged battery may result in sparks as initial contact is made. Such sparks could then ignite explosive gases that may be present about the batteries. In view of the inherent danger involved in connecting cable clamps to battery terminals, it remains desirable to suppress, isolate or eliminate conductive components of the clamp to prevent such sparking.

Moreover, the configuration of present cable clamps may cause short circuiting of a vehicle electrical system. Typically, a clamping jaw is attached to the jaw portion of a clamp member opposite the contact jaw to provide secure attachment to the battery terminals. Although isolated from the contact jaw, the clamping jaw is made of a conductive material, as well as the handles and mounting hardware of the clamp. When the contact jaw and clamping jaw are secured to a battery terminal, these conductive components of the clamp can provide a short circuit current path for the vehicle electrical system. It therefore remains desirable to inhibit the current flow through the clamping jaw to prevent a short circuit in the vehicle electrical system.

SUMMARY OF THE INVENTION

In view of the above, and in accordance with one aspect of the present invention, there is provided a clamp assembly for a battery booster cable for removable attachment to a battery terminal. The clamp assembly includes a pair of clamp members each having a jaw portion and a handle portion. One of the jaw portions is configured with an electrically conductive serrated edge, and the other jaw portion is configured with an insulated serrated edge. The electrically conductive serrated edge and insulated serrated edge cooperate to securely mount the clamp assembly to the battery terminal. A pivot pin joins the clamp members together between the respective jaw and handle portions thereof to allow pivotal movement of the clamp members relative to one another about the pivot pin. A biasing member is also disposed on the clamp members for normally urging the handle portions apart and the jaw portions together about the pivot pin.

In a preferred form of the invention, the electrically conductive serrated edge is configured as an electrically conductive contact jaw separately attached to the jaw portion of an active clamp member. Thus, the flow of the boost current is primarily through the contact jaw and is substantially isolated from the handle portion of the active clamp member. This maximizes current flow to the battery terminal and minimizes the heat buildup of the handles. To provide an electrical connection between the contact jaw and a source of current, a stranded copper cable is attached to the contact jaw. Preferably, the cable has an end portion crimped within the end of the contact jaw for making the mechanical and electrical connection between the end of the cable and the contact jaw.

Also preferably, each of the clamp members is formed of a one-piece construction of a metallic material and is entirely coated with a layer of non-conductive insulating material. The insulating serrated edge is preferably configured as teeth formed on the jaw portion of a passive clamp member, wherein the teeth are also coated with the insulating material. Thus, when the insulated teeth and the contact jaw are secured to a battery terminal, current will not travel through the insulated teeth, thereby preventing a short circuit from damaging the vehicle electrical system.

The clamp of the present invention is also configured to suppress, isolate or eliminate conductive components of the clamp to prevent sparking. More particularly, each conductive component of the clamp is shielded from contact with external electrically energized conductors. This protection is provided by recessing the contact jaw, the biasing member or spring, and all assembly hardware below the surface of the insulated clamp members. For example, the contact jaw is secured to the active clamp member by a rivet which is received in a recess in the clamp member. Similarly, the pivot pin is recessed below the surface of each clamp member to shield the pin from contact with external electrically energized conductors.

To provide ready identification of the polarity of the respective clamps and cables, appropriate polarity markings are placed on the clamp members. The polarity markings can be stamped on the handle portions of the clamp members or can be placed on labels affixed to the clamp members. The markings can constitute the symbols "+" or "−" and/or the words or abbreviations for "positive" or "negative". Preferably, at least one of the polarity markings is made of a phosphorescent material to allow an operator to identify the markings in dim light.

Also preferably, each handle portion of the clamp includes spaced-apart wing sections through which the pivot pin extends. To prevent "scissoring" and improve the stability of the clamp member connection, the wing sections of one handle portion overlap the wing sections of the other handle portion. A mechanical stop is also formed on each wing section of the active handle portion to prevent contact between the contact jaw of the active clamp member and the insulated serrated edge of the passive clamp member.

The present invention provides significant advantages over other battery booster clamp assemblies. The flow of the boost current is primarily through the contact jaw and is substantially isolated from the handle portion of the clamp member. Moreover, when the insulated teeth and the contact jaw are secured to a battery terminal, the insulated coating on the teeth will prevent current from traveling through the teeth, thereby preventing a short circuit from damaging the vehicle electrical system. In addition, the conductive components of the clamp are shielded from contact with external electrically energized conductors to prevent sparking.

The present invention, together with further objects and advantages, will be best understood by reference to the following detailed description taken in conjunction with the accompanying drawings.

DETAILED DESCRIPTION OF THE PREFERRED EMBODIMENT

Figure 1:
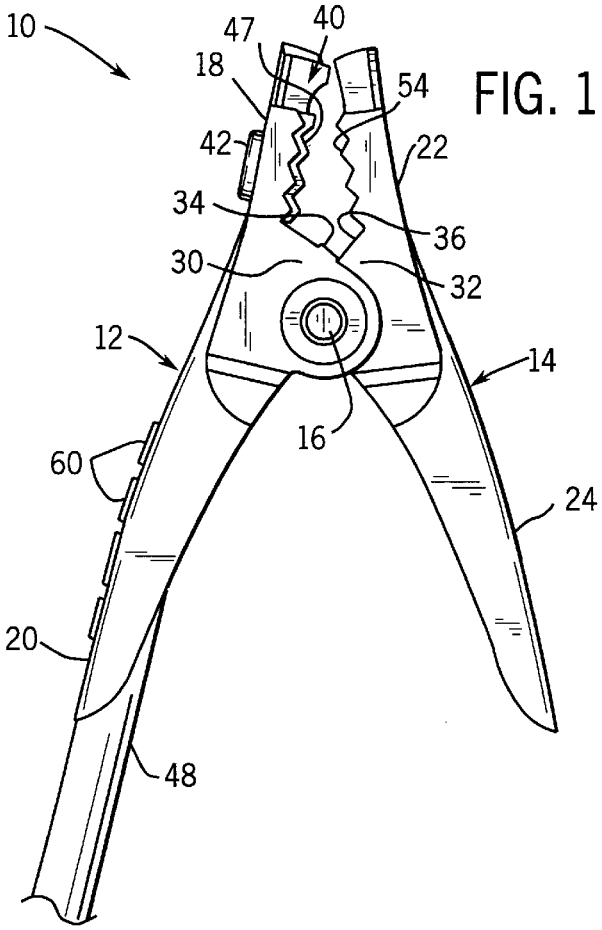
FIG. 1 is a front view of a preferred clamp assembly illustrating features of the present invention with a section of conductive jumper cable attached thereto.

While the present invention is susceptible of embodiment in various forms, there is shown in the drawings and will hereinafter be described a preferred embodiment of the invention with the understanding that the present disclosure is to be considered as setting forth an exemplification of the invention which is not intended to limit the invention to the specific embodiment illustrated.

Figure 2:
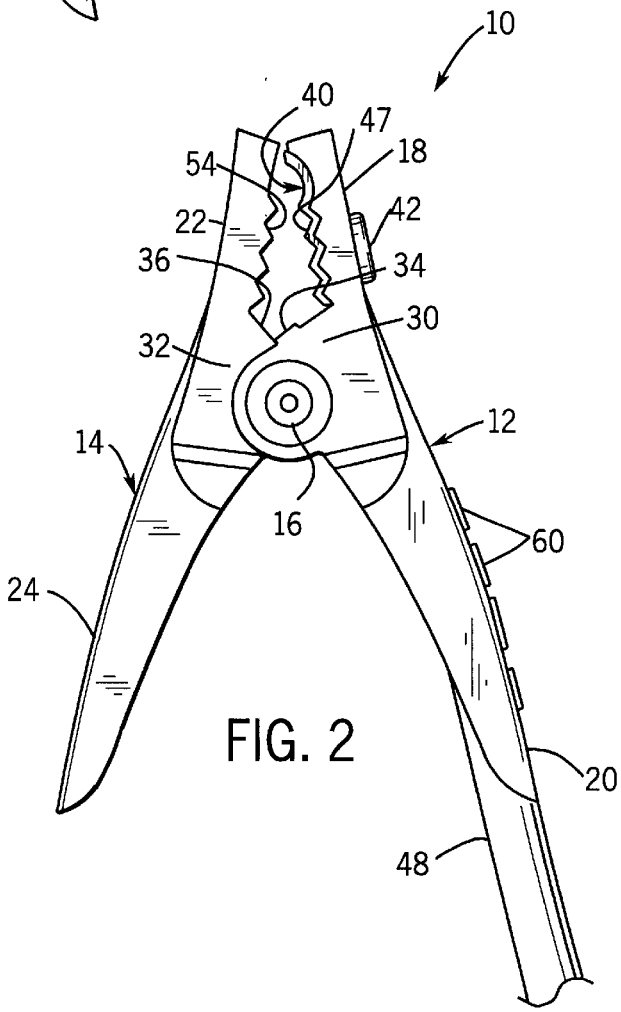
FIG. 2 is a rear view of the clamp assembly.
Figure 3:
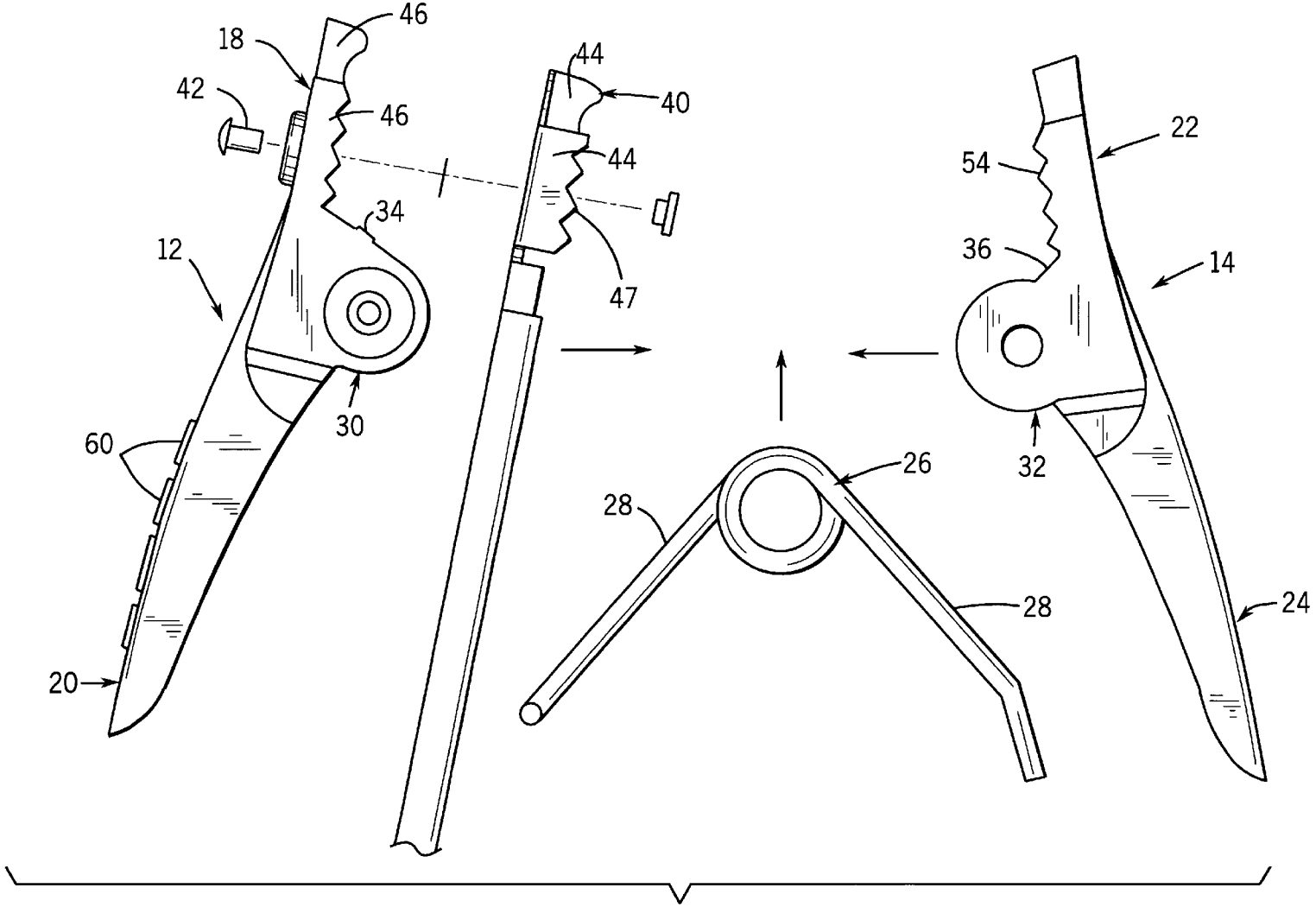
FIG. 3 is an exploded front view of the clamp assembly illustrating various components thereof.
Figure 4:
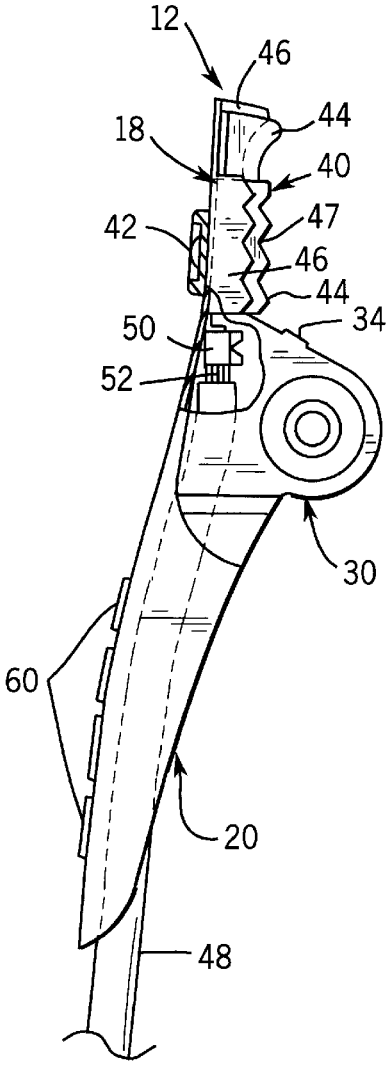
FIG. 4 is an enlarged front view of an active clamp member shown partially in section to illustrate the connection of a cable to a contact jaw.
Figure 5:
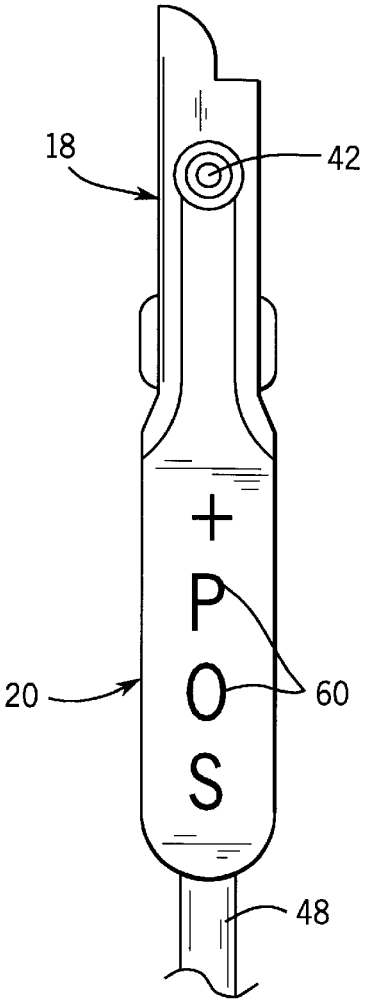
FIG. 5 is a left side view of the active clamp member shown in FIG. 4 illustrating polarity markings on the exterior of a handle portion of the active clamp member.

Referring now to the drawings, wherein like reference numerals refer to like parts throughout the several views, there is shown in FIGS. 1–3 a clamp assembly 10 for removable attachment to a battery terminal (not shown). Although only one clamp assembly 10 is shown, it will be understood by those skilled in the art that four clamp assemblies 10 are provided in a typical jumper cable set, one at each end of two cables.

As shown in FIGS. 1–3, the clamp assembly 10 includes an active clamp member 12 pivotally attached to a passive clamp member 14 by a pivot pin or rivet 16. The active clamp member 12 is of a one-piece construction defining a jaw portion 18 and a handle portion 20. The passive clamp member 14 is similarly constructed with a jaw portion 22 and a handle portion 24. The active and passive clamp members 12 and 14 are made of a metallic material and are entirely coated with a layer of non-conductive insulating material. Preferably, the metallic material is steel or similar metal, and the insulating material is a thin coating of PVC. As shown in FIG. 3, a torsion spring 26 is mounted about the rivet 16 (FIGS. 1–2) and has a pair of legs 28 which operably engage the respective handle portions 20, 24 of the clamp members 12, 14. Thus, the spring 26 normally urges the handle portions 20, 24 apart and the jaw portions 18, 22 together. To force the jaw portions 18, 22 apart, a user grips the handle portions 20, 24 and forces them together.

Figure 6:
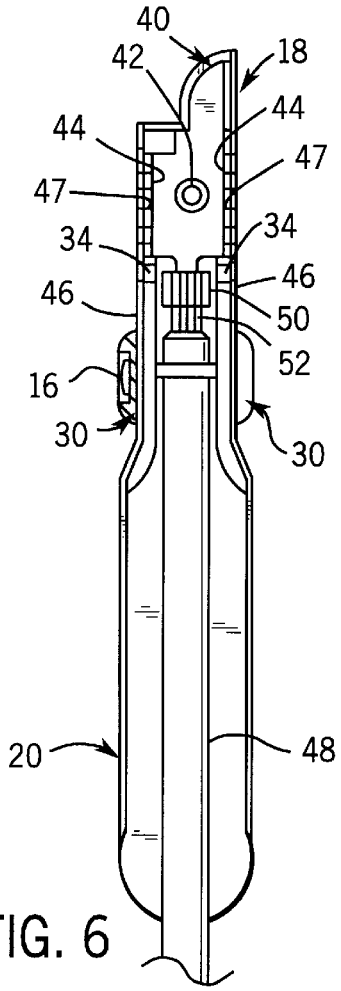
FIG. 6 is a right side view of the active clamp member illustrating the connection of the cable to the contact jaw; I
Figure 7:
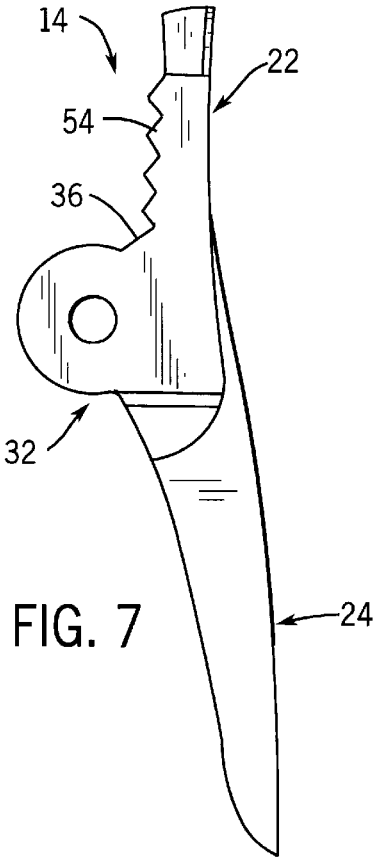
FIG. 7 is a right side view of a passive clamp member of the clamp assembly.
Figure 8:
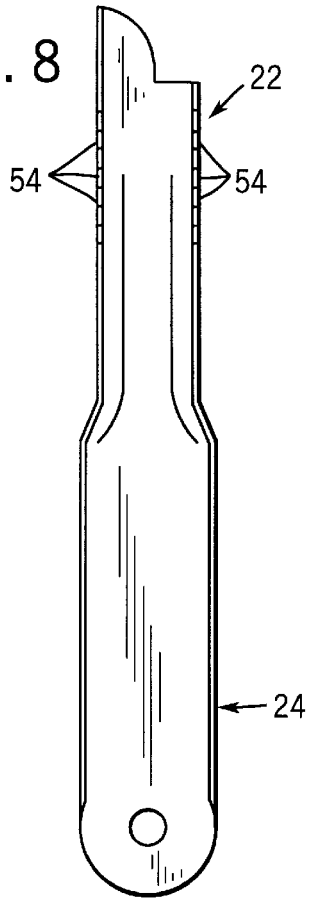
FIG. 8 is a left side view of the passive clamp member shown in FIG. 7.

Preferably, the rivet 16 extends through spaced apart wing sections 30 on the active clamp member 12 and spaced apart wing sections 32 on the passive clamp member 14. The wing sections 30 extend from between the jaw portion 18 and handle portion 20 of the active clamp member 12 toward the passive clamp member 14. Similarly, the wing sections 32 extend from between the jaw portion 22 and the handle portion 24 of the passive clamp member 14 toward the active clamp 12. To prevent "scissoring" and improve the stability of the clamp assembly 10, the wing sections 30 of the active clamp member 12 overlap the outside of the wing sections 32 of the passive clamp member 14. A mechanical stop 34 is also formed on each wing section 30 of the active clamp member 12 to limit the pivotal movement of the clamp members 12 and 14 relative to each other. The stops 34 are adapted to contact corresponding edges 36 of the wing sections 32 on the passive clamp member 14 to prevent inadvertent contact between the jaw portions 18, 22 of the clamp members 12, 14. As best shown in FIG. 6, the stops 34 are preferably configured as flanges that extend inwardly in order to contact the wing section edges 36 of the passive clamp member 14.

To allow current to flow to or from a battery terminal, an electrically conductive contact jaw 40 is secured interiorly of the jaw portion 18 of the active clamp member 12 (FIGS. 1–4 and 6). Preferably, the contact jaw 40 is made of copper-plated steel and is separately attached to the jaw portion 18 by a rivet 42 or similar fastener. As will be described in more detail below, a cable conductor 48, which is associated with each clamp assembly 12, is connected directly to the contact jaw 40. As a result, the flow of the boost current is primarily through the contact jaw 40 and is substantially isolated from the handle portion 20 of the active clamp member 12. This maximizes current flow to the battery terminal and minimizes the heat buildup of the handles.

Figure 10:
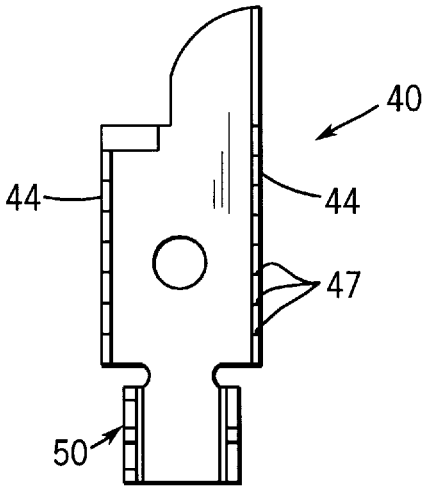
FIG. 10 is an enlarged side view of the contact jaw.
Figure 11:
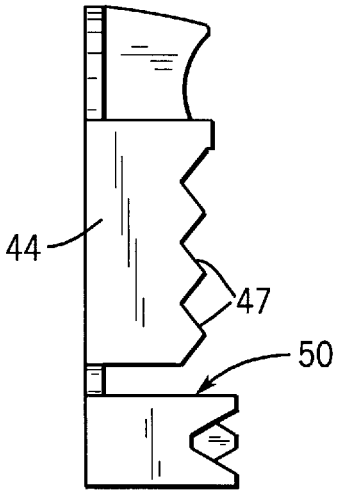
FIG. 11 is a front view of the contact jaw shown in FIG. 10.
Figure 12:
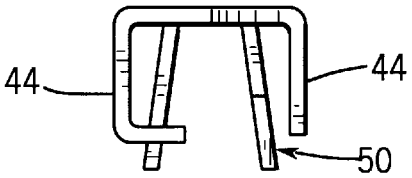
FIG. 12 is a top view of the contact jaw.

Preferably, the contact jaw 40 has side walls 44 spaced apart approximately the same distance as side walls 46 of the active clamp member 12 to provide a close fit between the two parts (FIG. 6). The side walls 44 of the contact jaw 40 also have serrated edges or teeth 47 formed thereon the to facilitate gripping securement to a battery terminal. To provide a mechanical and electrical connection between the end of a cable conductor 48 and the contact jaw 40 , the contact jaw 40 is configured with a terminal end portion 50 capable of being crimped. Preferably, the cable 48 is a stranded copper cable having an end portion 52 that is crimped within the terminal end portion 50 of the contact jaw 40. An enlarged view of the contact jaw 40 is illustrated in FIGS. 10–12.

To further facilitate securement of the clamp 10 to a battery terminal, the jaw portion 22 of the passive clamp member 14 defines serrated edges or teeth 54 which are coated with the insulating material. Thus, the conductive serrated edges 47 of the contact jaw 40 and the insulated serrated edges 54 of the passive clamp jaw portion 24 cooperate under the action of the spring 26 to securely mount the cl amp assembly 10 to a battery terminal. When the insulated teeth 54 and the contact jaw 40 are secured to a battery terminal, current will not travel through the insulated teeth 54 or the passive clamp member 14, thereby preventing a short circuit from damaging the vehicle electrical system.

The clamp assembly 12 of th e present invention is also configure d to suppress or isolate conductive components of th e clamp assembly 12 to prevent sparking. More particularly, each conductive component of the clamp assembly 12 is shielded from contact with external electrically energized conductors. This protection is provided by recessing the contact jaw 40, the spring 26, and rivets 16 and 42 and all other assembly hardware below the major contacting surface of the insulated clamp members 12 and 14 or associated non-conductive hardware. Moreover, the coating of insulating material on both the active and passive clamp members 12 and 14 further prevent sparking.

Figure 9:
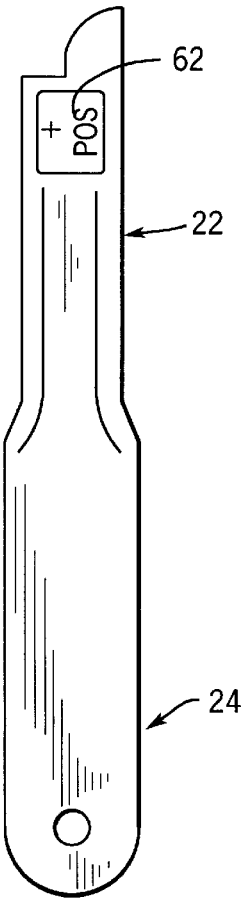
FIG. 9 is a right side view of the passive clamp member.

To provide ready identification of the polarity of the respective clamp assemblies and cables, appropriate polarity markings are either stamped on the clamp members 12 and 14 or affixed thereto on a label. For example, the polarity markings can constitute the symbols "+" or "−" or the words or abbreviations for "positive" or "negative", or both. The markings can also be colored in the conventional red to designate positive and black to designate negative polarity. In the illustrated embodiment, markings 60 are stamped on an exterior portion of the active clamp member 12 (FIGS. 1–5), and markings 62 are placed on the exterior of the passive clamp member 14 (FIG. 9). Preferably, the polarity markings 62 are made of a phosphorescent material to allow an operator to identify the markings in dim light.

Thus, a cable assembly is provided which directs the flow of boost current primarily through the contact jaw and prevents a short circuit through the passive jaw portion of the clamp assembly. In addition, the conductive components of the clamp are shielded from contact with external electrically energized conductors to prevent sparking, and polarity markings are provided for ready identification of the polarity of the respective clamp assemblies.

From the foregoing, it will be observed that numerous modifications and variations can be effected without departing from the true spirit and scope of the novel concept of the present invention. It will be appreciated that the present disclosure is intended as an exemplification of the invention, and is not intended to limit the invention to the specific embodiment illustrated. The disclosure is intended to cover by the appended claims all such modifications as fall within the scope of the claims.

What is claimed is:

1. A clamp assembly for a battery booster cable for removable attachment to a battery terminal, comprising:

a pair of clamp members each including a jaw portion and a handle portion, one of said jaw portions being configured with an electrically conductive edge portion, and the other of said jaw portions being configured with a non-conductive edge portion, said electrically conductive edge portion and non-conductive edge portion cooperating to securely mount the clamp to the battery terminal;

a pivot member joining the clamp members together between the respective jaw and handle portions thereof to allow pivotal movement of the clamp members relative to one another about the pivot member; and a biasing member disposed on the clamp members for normally urging the handle portions apart and the jaw portions together about the pivot member.

2. The clamp assembly of claim 1 wherein the electrically conductive edge portion is defined as an electrically conductive contact jaw attached to one of said jaw portions of the clamp member.

3. The clamp assembly of claim 2 wherein each of said jaw portions is coated with a non-conductive insulating material.

4. The clamp assembly of claim 3 wherein each of said handle portions is coated with a non-conductive insulating material.

5. The clamp assembly of claim 2 wherein the contact jaw is releasably secured to one of said jaw portions by a fastener, said fastener being recessed to thereby shield said fastener from contact with conductive objects.

6. The clamp assembly of claim 5 wherein the pivot member is recessed below the surface of each clamp member to shield said pivot member from contact with external electrically energized conductors.

7. The clamp assembly of claim 2 further comprising a cable conductor secured to said contact jaw to provide an electrical connection between the contact jaw and a source of current.

8. The clamp assembly of claim 7 wherein said cable conductor comprises a stranded copper cable having an end portion crimped within the end of said electrically conductive contact jaw for making the mechanical and electrical connection between the end of the cable and the contact jaw.

9. The clamp assembly of claim 2 wherein each of said clamp members is formed of a one-piece construction of a metallic material and entirely coated with a layer of non-conductive insulating material.

10. The clamp assembly of claim 1 further comprising a mechanical stop disposed on one of the clamp members to prevent contact between the respective serrated edges to biasing of spring.

11. The clamp assembly of claim 1 further comprising polarity markings disposed on one of said clamp members.

12. The clamp assembly of claim 11 wherein said polarity markings are configured with a phosphorescent material to facilitate visibility in poor lighting conditions.

13. The clamp assembly of claim 1 wherein each handle portion includes spaced-apart wing sections through which said pivot member extends, the wing sections of one handle portion overlapping the wing sections of the other handle portion to improve the stability of the clamp connection.

14. The clamp assembly of claim 13 further comprising a mechanical stop formed on an edge of each wing section of one of said handle portions.

15. A clamp assembly for a battery booster cable for removable attachment to a battery terminal, comprising:

an active clamp member coated with an insulating material, said active clamp member having a jaw portion and a handle portion;

an electrically conductive contact jaw attached to said jaw portion of the active clamp member and having a serrated edge for gripping securement to the battery terminal;

a passive clamp member coated with an insulating material, said passive clamp member having a handle portion and an insulated jaw portion defining a serrated edge for gripping securement to the battery terminal;

a pivot member joining the active and passive clamp members together between the respective jaw portions and handle portions to allow pivotal movement of the active and passive clamp members relative to one another about the pivot member; and a spring operably engaging the active and passive clamp members for normally urging the respective handle portions apart and the respective jaw portions together about the pivot member, the contact jaw of the active clamp member and the insulated serrated edge of the passive clamp member cooperating to securely mount the clamp to the battery terminal.

16. The clamp assembly of claim 15 wherein the contact jaw is releasably secured to the jaw portion of the active clamp by a fastener, said fastener being recessed to thereby shield said fastener from contact with conductive objects.

17. The clamp assembly of claim 16 wherein the pivot member is recessed below the surface of each clamp member to shield said member from contact with external electrically energized conductors.

18. The clamp assembly of claim 15 further comprising a cable conduct or secured to said contact jaw to provide an electrical connection between the contact jaw and a source of current.

19. The clamp assembly of claim 18 wherein said cable conductor comprises a stranded copper cable having an end portion crimped within the end of said electrically conductive contact jaw for making the mechanical and electrical connection between the end of the cable and the contact jaw.

20. The clamp assembly of claim 15 wherein each of said clamp members is formed of a one-piece construction of a metallic material and entirely coated with a layer of non-conductive insulating material.

21. The clamp assembly of claim 15 further comprising a mechanical stop disposed on one of the handle portions to prevent contact between the contact jaw of the active clamp member and the insulated serrated edge of the passive clamp member due to biasing of spring.

22. The clamp assembly of claim 15 further comprising polarity markings formed on the handle portion of one of said active and passive clamp members.

23. The clamp assembly of claim 22 wherein said polarity markings are made of a phosphorescent material.

24. The clamp assembly of claim 15 wherein each handle portion includes spaced-apart wing sections through which said pivot member extends, the wing sections of one handle portion overlapping the wing sections of the other handle portion to improve the stability of the clamp connection.

25. The clamp assembly of claim 15 further comprising a mechanical stop formed on an edge of each wing section of one of said handle portions.

26. A clamp assembly for a battery booster cable for removable attachment to a battery terminal, comprising:

an active clamp member coated with an insulating material, said active clamp member having a jaw portion and a handle portion;

an electrically conductive contact jaw attached to said jaw portion of the active clamp member and having a serrated edge for gripping securement to the battery terminal;

a cable conductor secured to said contact jaw to provide an electrical connection between the contact jaw and a source of current;

a passive clamp member coated with an insulating material, said passive clamp member having a handle portion and a jaw portion defining a serrated edge for gripping securement to the battery terminal;

a pivot member joining the active and passive clamp members together between the respective jaw portions and handle portions to allow pivotal movement of the active and passive clamp members relative to one another about the pivot member;

a spring operably engaging the active and passive clamp members for normally urging the respective handle portions apart and the respective jaw portions together about the pivot member, the contact jaw of the active clamp member and the insulated serrated edge of the passive clamp member cooperating to securely mount the clamp assembly to the battery terminal; and a mechanical stop disposed on one of the handle portions to prevent contact between the contact jaw of the active clamp member and the insulated serrated edge of the passive clamp member due to biasing of spring.

27. A clamp assembly for a battery booster cable for removable attachment to a battery terminal, comprising:

an active clamp member having a handle portion and an active jaw portion, said active jaw portion having an electrically conductive contact jaw attached thereto for gripping securement to the battery terminal;

a passive clamp member having a handle portion and a passive jaw portion, said passive jaw portion defining a gripping edge integrally formed thereon for gripping securement to the battery terminal, said electrically conductive contact jaw and gripping edge cooperating to securely mount the clamp to the battery terminal;

a pivot member joining the clamp members together between the respective jaw and handle portions thereof to allow pivotal movement of the clamp members relative to one another about the pivot member; and a biasing member disposed on the clamp members for normally urging the handle portions apart and the jaw portions together about the pivot member.

* * * * *